United States Patent [19]

Tomizu et al.

[11] Patent Number: 4,564,730

[45] Date of Patent: Jan. 14, 1986

[54] ELECTRICAL SWITCH

[75] Inventors: Motoyuki Tomizu; Kunio Nagata, both of Kyoto, Japan

[73] Assignee: Omron Tateisi Electronics Co., Kyoto, Japan

[21] Appl. No.: 641,560

[22] Filed: Aug. 16, 1984

[30] Foreign Application Priority Data

| | | | |
|---|---|---|---|
| Aug. 16, 1983 | [JP] | Japan | 58-127136[U] |
| Aug. 23, 1983 | [JP] | Japan | 58-130721[U] |
| Sep. 16, 1983 | [JP] | Japan | 58-143772[U] |
| Sep. 22, 1983 | [JP] | Japan | 58-146776[U] |

[51] Int. Cl.[4] ..... H01H 15/00; H01H 3/16

[52] U.S. Cl. ..... 200/16 B; 200/61.76; 200/159 R

[58] Field of Search ..... 200/16 B, 16 D, 16 E, 200/52 R, 61.76–61.83, 61.85, 159 R, 275, 276

[56] References Cited

U.S. PATENT DOCUMENTS

| | | | |
|---|---|---|---|
| 2,065,904 | 12/1936 | Meuer | 200/159 R |
| 2,436,898 | 2/1948 | Rickmeyer | 200/61.76 X |
| 2,439,500 | 4/1948 | Wood | 200/159 R |
| 3,172,981 | 3/1965 | Loesch | 200/67.76 X |
| 3,225,149 | 12/1965 | Shlesinger, Jr. | 200/16 D |
| 3,474,198 | 10/1969 | Conrad | 200/16 B |

*Primary Examiner*—J. R. Scott

*Attorney, Agent, or Firm*—Wegner & Bretschneider

[57] ABSTRACT

An electrical switch which includes a casing, a pair of fixed contacts each formed by cutting a rod member into a predetermined length, and disposed in the casing to confront each other, a plunger slidably accommodated in the casing for movement in an axial direction, bearing members slidably supporting the plunger, a movable contact formed by cutting a rod member into a predetermined length and mounted to an intermediate portion of the plunger in a direction intersecting with the fixed contacts, and a return spring directed around the outer periphery of the plunger. The movable contact is restored together with the plunger to close the pair of fixed contacts in a free state.

5 Claims, 13 Drawing Figures

60
50
52
53
51
61
40
40a
F
20
45
22
21
10
1
38
6
2
70
71
39
37
35
9
47
30
36
8
L
L1
L2
L3
a
a'
d

ELECTRICAL SWITCH

BACKGROUND OF THE INVENTION

The present invention generally relates to an electrical switch and more particularly, to a high precision electrical switch of a small size.

Conventionally, for electrical switches with contacts employed, for example, for detecting positions of various objects, there have been employed switches which adopt a reversing mechanism and those which utilizes a leaf contact, for example. However, each of such known switches, which employs a plate spring, has such a disadvantage that scattering of functioning positions of the contacts thereof tends to be large.

In order to eliminate the inconvenience as described above, there has also been conventionally proposed an electrical switch which is so arranged that an electrically conductive spherical member urged by a return spring contacts a pair of fixed contacts for constituting normally closed contacts, while the spherical member is adapted to be spaced from the respective fixed contacts against the urging force of the return spring by depressing a plunger.

The known switch arrangement as described above, however, still has such drawbacks that not only cost of the switch becomes high due to employment of the spherical member, but also the switch itself tends to be large in size, since the plunger, spherical member (movable contact), and return spring are aligned, as it were, in series. Meanwhile, the sliding span or distance of the plunger should preferably be as long as possible for stable operation, with a less adverse effect to accuracy due to a looseness or side play, but in the switch arrangement referred to above, if the sliding span is set to be long, the size of the switch itself is inevitably increased, and thus, a sufficiently long span can not be provided for achieving a high accuracy.

SUMMARY OF THE INVENTION

Accordingly, an essential object of the present invention is to provide an improved small-sized and high precision electrical switch, with a substantial elimination of disadvantage inherent in the conventional electrical switches of this kind.

Another important object of the present invention is to provide an electrical switch of the above described type which is simple in construction and stable in functioning at high reliability, and can be produced on a large scale at low cost.

In accomplishing these and other objects, according to one preferred embodiment of the present invention, there is provided an electrical switch which comprises a casing, a pair of fixed contacts each formed by cutting a rod member into a predetermined length, and disposed in the casing to confront each other, a plunger slidably accommodated in the casing for movement in an axial direction, bearing members slidably supporting the plunger, a movable contact formed by cutting a rod member into a predetermined length and mounted to an intermediate portion of the plunger in a direction intersecting with the fixed contacts, and a restoring means directed around the outer periphery of the plunger. The movable contact is adapted to be returned together with the plunger to close the pair of fixed contacts in a free state.

More specifically, in the above arrangement of the present invention, since the movable contacts, the pair of fixed contacts, and the restoring means such as a return spring, or the like are provided at the intermediate portion of and around the plunger, with the plunger being slidably supported by the bearing members, the switch may be constructed to be extremely compact in the longitudinal direction of the plunger, and owing to the facts that the sliding spun of the plunger may be set comparatively long, while the contacts are formed into a cross bar construction through employment of rod members, highly accurate functionings of the contacts may be achieved. Moreover, by forming the contacts from the rod members, the overall cost for the switch may be appreciably reduced.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
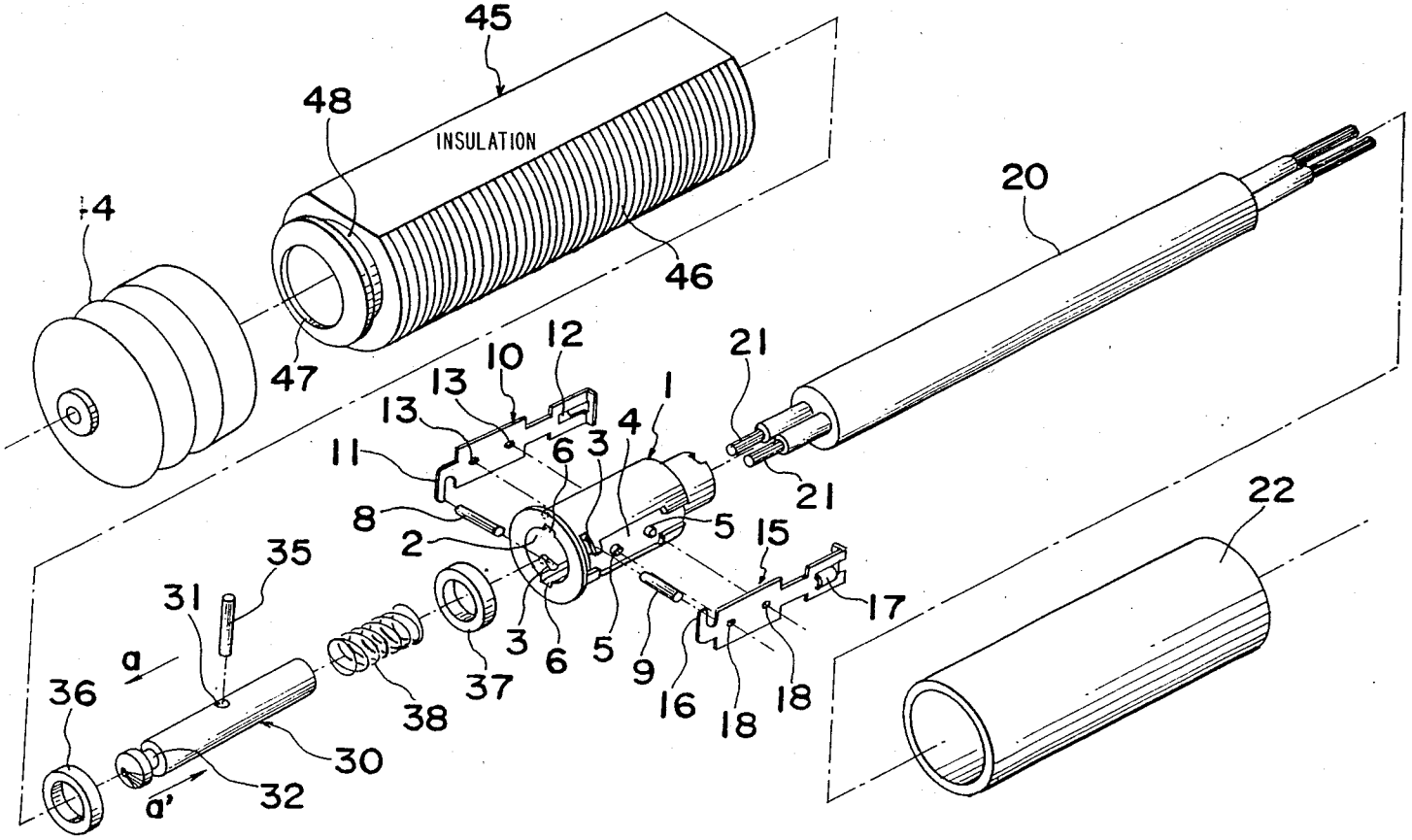
FIG. 1 is an exploded perspective view of an electrical switch according to one preferred embodiment of the present invention, FIG. 1(*a*) is a cross sectional view showing a state where lead terminals are fitted into corresponding recesses of a casing employed in the electrical switch of FIG. 1.

Before the description of the present invention proceeds, it is to be noted that like parts are designated by like reference numerals throughout the accompanying drawings.

Referring now to the drawings, there is shown in FIGS. 1 to 4 an electrical switch according to one preferred embodiment of the present invention, which generally includes an inner casing 1, fixed contacts 8 and 9, lead terminals 10 and 15, a plunger 30, a movable contact 35, bearing members 36 and 37, a return spring 38, and an outer casing 45.

The inner casing 1 is molded as one unit by a proper synthetic resin or the like, and the lead terminals 10 and 15 are integrally blanked from an electrically conductive metallic thin plate by press work, while the fixed contacts 8 and 9 are prepared by cutting a contact material in the form of a round rod into a predetermined length. These fixed contacts 8 and 9 are each fixed to projections 11 and 16 of the lead terminals 10 and 15 by spot welding at one end face thereof, and are inserted into through-holes 3 formed in the inner casing 1 in a direction intersecting at right angles with a central bore 2 of said inner casing 1. In the inserted state, the fixed contacts 8 and 9 are exposed at their central portions within the central bore 2 to confront each other. The lead terminals 10 and 15 have cores 21 of an external cord 20 preliminarily soldered at semi-circular curved portions 12 and 17 thereof, and are fitted into corresponding stepped portions or recesses 4 formed on the outer peripheral surface of the inner casing 1. The lead terminals 10 and 15 themselves are temporarily fixed to the casing 1 by fitting small projections 5 provided on the recesses 4 into corresponding holes 13 and 18 formed in said lead terminals. The recesses 4 referred to above are formed in the configuration generally similar to that of the lead terminals 10 and 15 on the outer peripheral surface of the inner casing 1. As shown in FIG. 1(*a*), a width W1 of the lead terminals 10 and 15 in a free state is formed to be slightly larger than a width W2 in a circumferential direction of the recess 4, and the lead terminals 10 and 15 are fitted into the recesses 4 in the state where they are deflected to be directed along the outer peripheral surface of the inner casing 1. In this case, the opposite ends of the respective lead terminals 10 and 15 engage the side wall portions 4*a* of the recesses 4 by a spring force or resiliency of their own so as to be prevented from falling. The side wall portions 4*a* of the recesses 4 are required to have a shape or angle suitable for receiving the spring force of the lead terminals 10 and 15, and in the present embodiment, each of the wall portions 4*a* has a plane parallel to the direction for attaching the lead terminal 10 or 15. Meanwhile, the lead terminals 10 and 15 are prevented from falling off also by fitting the holes 13 and 18 thereof over the small projections 5, but the fixing by the side wall portions 4*a* and the small projections 5 is of the temporary fixing during assembling, and these lead terminals 10 and 15 are subjected to a positive fixing as well as an electrical insulation by applying a heat shrinkable tube 22 over the assemblage later.

Although heat caulking or staking of the small projections 5 may be considered, but such a practice is not necessarily preferable since it may invite an increase of manufacturing steps.

On the other hand, the plunger 30 is slidably provided in the central bore 2 of the inner casing 1 through bearing members 36 and 37 made, for example, of ceramics, with the movable contact 35 being inserted into a hole 31 formed at approximately an intermediate portion of said plunger 30. This movable contact 35 is prepared by cutting a contact material in the form of a round rod to a predetermined length, such as to a length slightly longer than a span of the fixed contacts 8 and 9, and is positioned in a direction to intersect with the fixed contacts 8 and 9, while within the central bore 2, groove portions 6 are formed so as to allow the opposite end portions of the movable contact 35 to be displaced. Around the plunger 30 and between the bearing 37 and the movable contact 35, the return spring 38 in a coil-like shape is disposed in a compressed state through a washer 39 (FIG. 3) so as to normally urge the movable contact 35 and the plunger 30 in the direction of the arrow a for providing a contact pressure by which the movable contact 35 is held in pressure contact with the fixed contacts 8 and 9.

It should be noted here that for assembling of the arrangement as described so far, the bearing member 37, return spring 38 and the plunger 30 having the movable contact 35 are inserted into the central bore 2 of the inner casing 1, and the fixed contacts 8 and 9 are inserted into the through-openings 3, in the state where the plunger 30 has been pressed into the central bore 2.

On the other hand, the outer casing 45 is made of a metallic cylinder, with a female thread 46 partly eliminated by a flat plane being formed on the outer peripheral surface thereof. The inner casing 1, etc. described earlier are inserted into the outer casing 45 from its rear end opening thereof, and accommodated in the outer casing 45, with the forward end portion of the plunger 30 being projected out of an opening 47 of the outer casing 45. Into an annular groove 48 of the outer casing 45 and another annular groove 32 formed at the forward end of the plunger 30, a bellows-like expansion and contraction rubber member 44 is fitted for sealing of the opening 47.

In the above arrangement, the movable contact 35 normally contacts the fixed contacts 8 and 9 by the spring force of the return spring 38 to keep the switch in the closed state. Upon depression of the plunger 30 in the direction of the arrow a′, the movable contact 35 is also displaced together with the plunger 30 against the spring force of the return spring 38 in the direction of the arrow a′, and thus, the fixed contacts 8 and 9 are spaced from the movable contact 35 for opening.

The electrical switch according to the present invention as described above may be mounted on a panel (not shown) or the like, by inserting the outer casing 45 into a mounting hole (not shown) of the panel, etc. and engaging nuts (not shown) onto the female thread 46 thereof from the front side and rear side of the panel.

More specifically, in the electrical switch of the present invention, the fixed contacts 8 and 9 are immediately opened upon depression of the plunger 30, with the movement up to the functioning (PT) being zero, while by forming the cross bar contacts by the round bar as the contact material, the functioning accuracy of the contacts has been remarkably improved. Moreover, since the plunger 30 is supported at the opposite ends by the bearing members 36 and 37, with a comparatively long sliding span L being available, influences due to a side play resulting from dimensional errors, etc. may be eliminated as far as practicable.

Meanwhile, since the movable contact 35 is provided at approximately the intermediate portion of the plunger 30, while the return spring 38 and the fixed contacts 8 and 9 are disposed around the plunger 30, the space is efficiently utilized to constitute a switch of a compact size. Furthermore, by forming the contacts 8, 9 and 35 from a rod material, especially a round rod, the switch may be produced at low cost.

Figure 6:
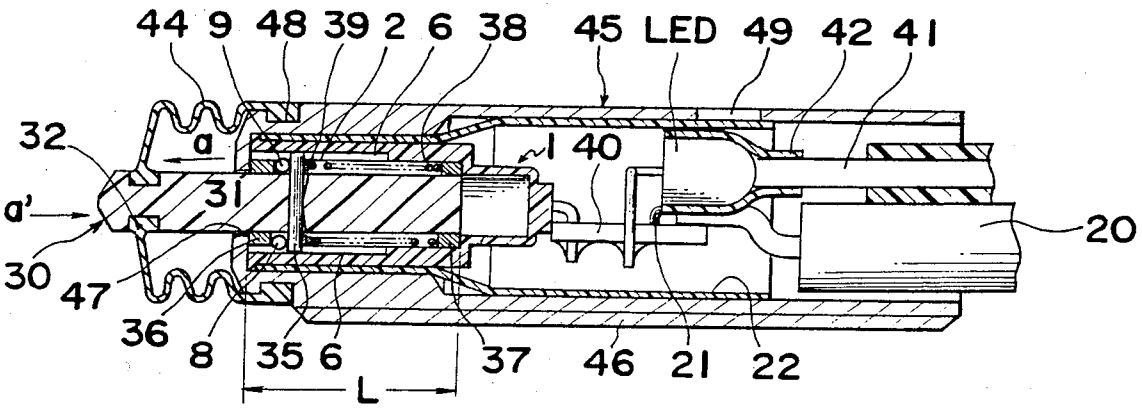
FIG. 6 is a vertical cross section at a central portion of the electrical switch of FIG. 1.
Figure 7:
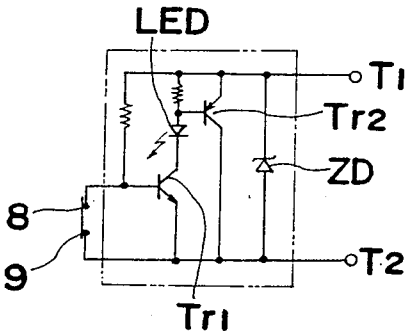
FIG. 7 is an electrical circuit diagram showing a switching circuit of the electrical switch of FIG. 5, FIGS. 8(*a*), 8(*b*) and 8(*c*) are fragmentary perspective views showing a modification related to the connection between fixed contacts and external cord.
Figure 1A:
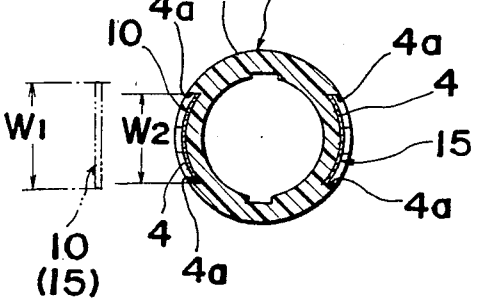
Figure 2:
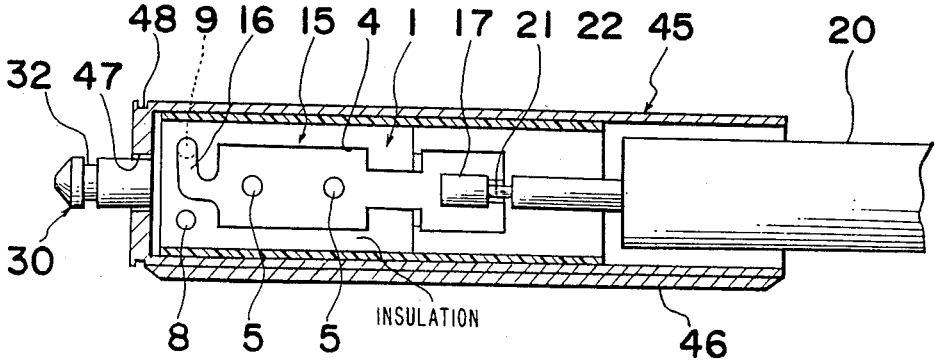
FIG. 2 is a front elevational view of the electrical switch of FIG. 1 in which an outer casing is sectioned.
Figure 3:
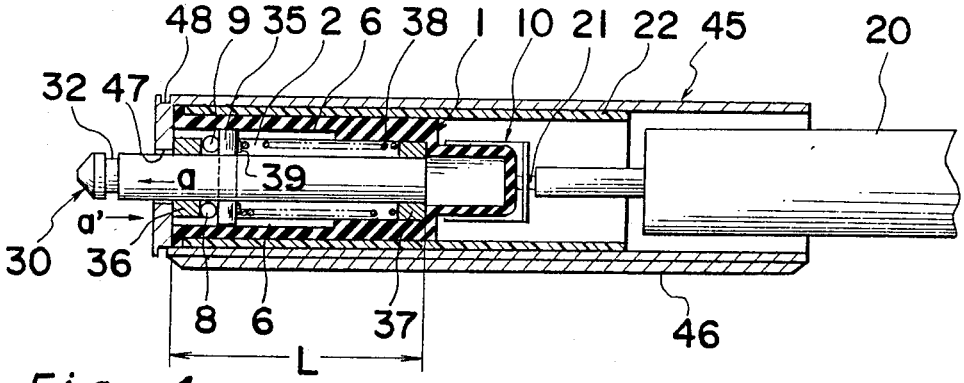
FIG. 3 is a vertical cross section at a central portion of the electrical switch of FIG. 1.
Figure 4:
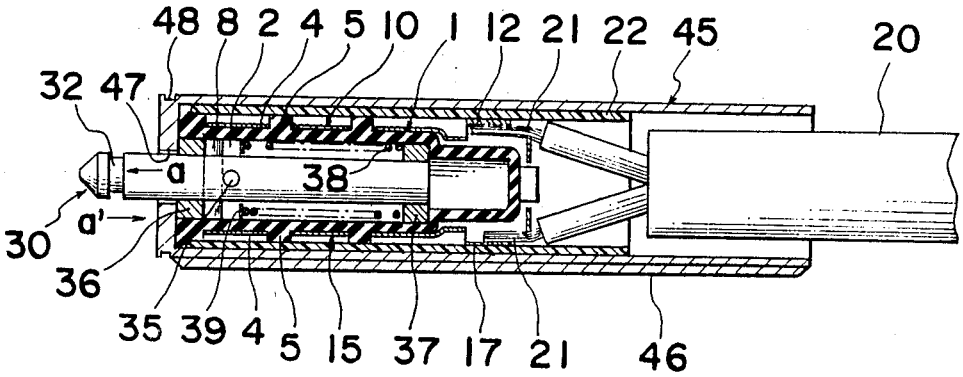
FIG. 4 is a horizontal cross section at a central portion of the electrical switch of FIG. 1.
Figure 5:
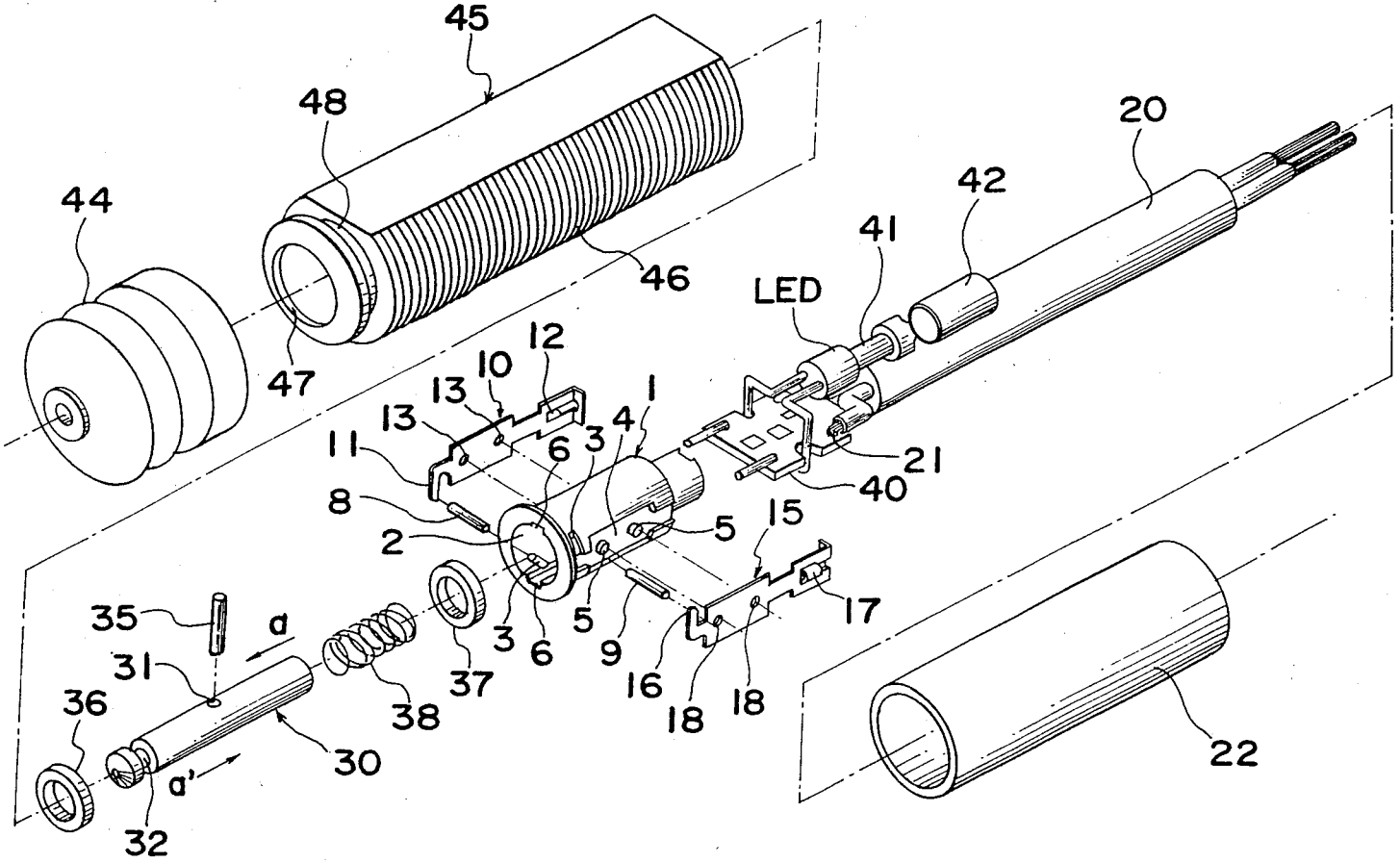
FIG. 5 is an exploded perspective view similar to FIG. 1, which particularly shows a second embodiment thereof.

Referring to FIGS. 5 through 7, there is shown an electrical switch according to a second embodiment of the present invention. In this embodiment adapted to take out a two line type non-contact output, although the arrangement of the inner casing 1, fixed contacts 8 and 9, lead terminals 10 and 15, plunger 30, movable contact 35, and outer casing 45 and/or other components is generally similar to that of the first embodiment, there is further provided a switching circuit in the form of an IC circuit between the lead terminals 10 and 15 and the external cord 20. As shown in FIG. 7, the above switching circuit includes two transistors Tr1 and Tr2 forming the known non-contact switch, with a Zener diode ZD for protection and a light emitting diode LED being inserted therebetween.

When a power source and a load are connected across terminals T1 and T2 of the switching circuit of FIG. 7, the transistors Tr1 and Tr2 are turned off in the case where the fixed contacts 8 and 9 are closed (the normal state of the switch according to the present invention), with the light emitting diode LED remaining de-energized. On the other hand, upon opening of the fixed contacts 8 and 9, both transistors Tr1 and Tr2 are turned on to feed current to the load, with the light emitting diode LED being lit.

The switching circuit as described above is formed on a printed substrate 40, with the light emitting diode LED being connected to one end portion of an optical fiber 41 through a transparent heat-shrinkable tube 42. Moreover, on the upper surface of the outer casing 45, there is formed a window portion 49 (FIG. 6) in a position corresponding to the disposed position of the light emitting diode LED. Accordingly, the lighting of the light emitting diode LED may be observed at the forward end portion of the optical fiber 41 and the window portion 49 of the outer casing 45. According to the second embodiment as described so far, based on the on/off of the contact signals of the fixed contacts 8 and 9, the non-contact signals from the transistors Tr1 and Tr2 may be derived, and in spite of the fact that the current flowing through the fixed contacts 8 and 9 is of a small quantity, a large amount of current may be caused to flow through the terminals T1 and T2. In other words, since only a small amount of current flows through the contacts 8, 9 and 35 even if a large amount of current is to be opened or closed, deterioration of the contacts may be reduced, so that the switch withstands a repeated use for a long period, with open/close characteristics at high accuracy being maintained.

In the above second embodiment, the connection between each core 21 and the substrate 40 may be modified as shown in FIGS. 8(*a*), 8(*b*) and 8(*c*).

More specifically, in the modification of FIGS. 8(*a*), 8(*b*) and 8(*c*), pins 61 of a connector 60 attached to one end of the external cord 20 are soldered to terminals 51 soldered to fixing holes 40*a* of the printed substrate 40. As shown in FIGS. 8(*a*) and 8(*b*), the terminals 51 is formed by press work as a terminal plate 50 so as to be preliminarily connected in one unit at a connecting portion 52, and the connecting portion 52 is adapted to be folded off at groove portions 53 formed into a triangular cross section. In the first place, this terminal plate 50 is inserted, at the terminals 51 thereof, into the fixing holes 40*a* of the printed substrate 40 for soldering, while the pins 61 of the connector 60 are soldered for connection of the wiring on the substrate 40 with the external cord 20, and thereafter, the connecting portion 52 is folded in the direction of an arrow F to break off the portion 52 (FIG. 8(*c*)) at the groove portions 53.

In the above modification, since the terminals 51 are formed into one unit by the connecting portion 52, they may be handled as a comparatively large part, and although the terminals 51 themselves are of symmetrically different shapes, they are not wrongly selected in an assembling and can be readily inserted into the fixing holes 40*a* by one operation. Moreover, if the terminals 51 are disposed separately, there will be such an inconvenience that they unstably move during the soldering of the pins 61 of the connector 60, but when the terminals 51 are provided as one unit as described above, the soldering of the pins 61 are facilitated without the undesirable movement thereof during the assembling.

Figures 8A, 8B, 8C, 9:
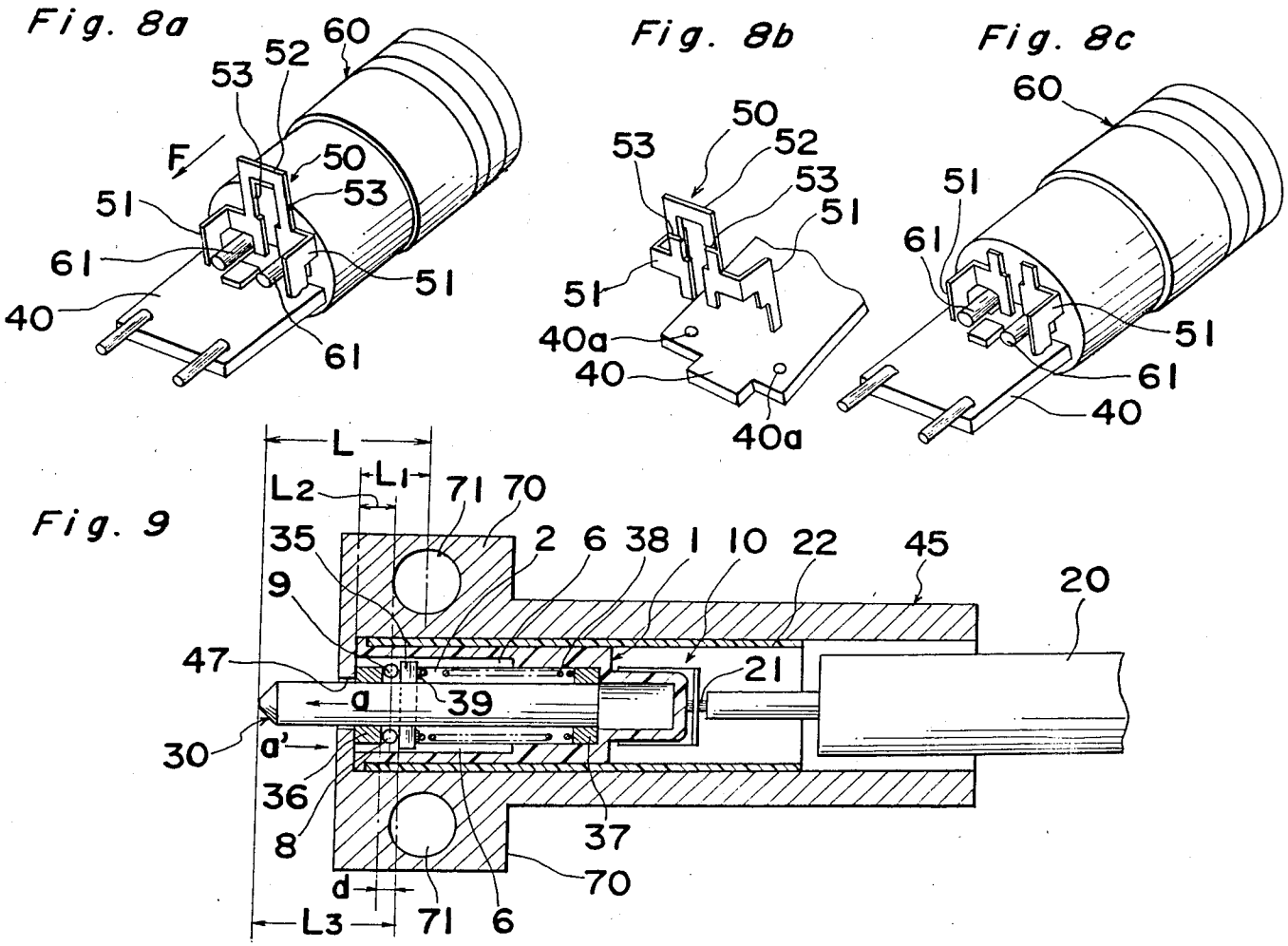
FIG. 9 is a cross section similar to FIG. 3, which particularly shows a modification thereof wherein accuracy of functioning positions with respect to temperature variations has been improved.
Figure 10:
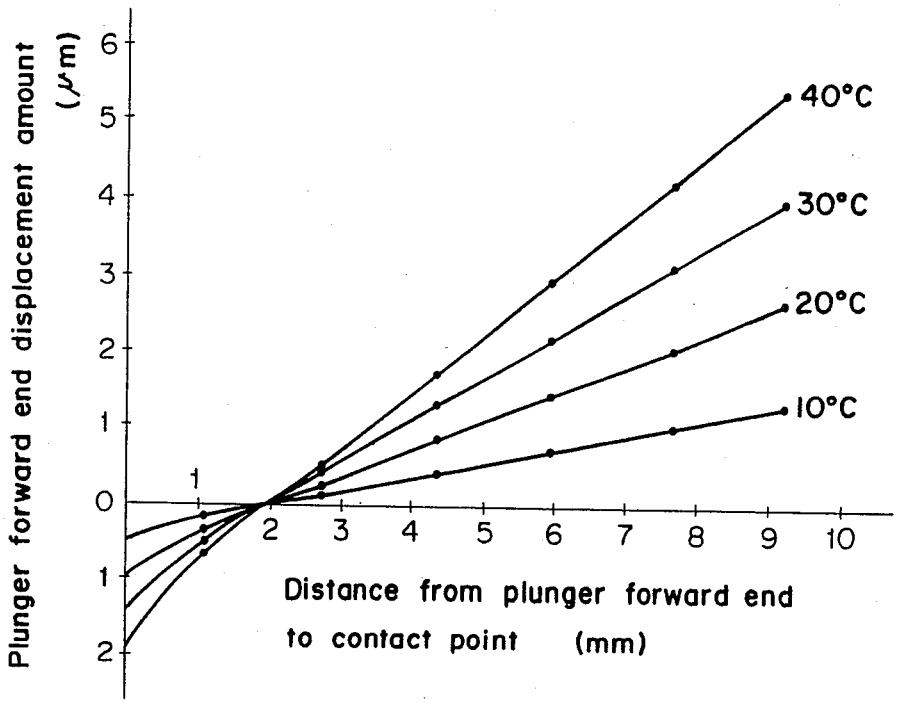
FIG. 10 is a graph showing varying characteristics with respect to the modification of FIG. 9.

Referring further to FIGS. 9 and 10, there is shown in FIG. 9, a further modification of the electrical switch according to the present invention. By this modification, it is intended to provide an high precision electrical switch in which scattering or deviation of the operating positions is extremely small with respect to temperature variations, such as when the temperature coefficient is equal to zero, in the switch as described in the foregoing embodiment. More specifically, in the electrical switch described with reference to the embodiment described so far, it is true that a high precision contact functioning may be realized, since the movable contact is immediately spaced from the fixed contacts upon depression of the plunger and thus, the movement up to the functioning (PT) is zero, but it is not necessarily considered so far that the functioning position of the contacts is constant even with respect to the temperature variations.

In the modification of FIG. 9, the inner casing 1 is molded into one unit from PBT (polybutylene terephthalate), and the lead terminals 10 and 15 are those integrally blanked from an electrically conductive thin plate by press work, while the fixed contacts 8 and 9 are prepared by cutting a contact material in the form of a round rod made of a beryllium-copper alloy to a predetermined length. The plunger 30 is composed of ceramics of alumina, and the bearing members 36 and 37 provided in the central bore 2 of the inner casing 1 are made of ceramics. The movable contact 35 is prepared by a contact material in the form of a round rod, cut into a predetermined length slightly longer than the span of the fixed contacts 8 and 9. The outer casing 45 is formed into a generally cylindrical shape from a stainless steel material, and has a pair of projections 70 provided at opposite sides in the forward portion thereof, with fixing holes 71 for fixing the switch to a panel or the like by screws being formed in said projections 70.

Here, investigations will be made into the scattering or deviation of the functioning positions with respect to temperature variations in the electrical switch of FIG. 9 according to the present invention.

Expansion or contraction of the respective members resulting from the temperature variations, exerts influence on a distance L from the center of the fixing hole 71 as the reference position to the forward end of the plunger 30. For example, the expansion of the outer casing 45 and the plunger 30 acts in the direction of the arrow a, and the expansion of the inner casing 1 and the fixed contacts 8 and 9 acts in the direction of the arrow a'. Substantially, what affect the distance L are a distance L1 (from the center of the fixing hole 47 to the forward end of the inner casing 1) multiplied by the temperature coefficient A of the outer casing 45, a distance L3 (from the forward end of the plunger 30 to the contact point thereof) multiplied by temperature coefficient B of the plunger 30, a distance L2 (from the forward end of the inner casing 1 to the fixed contacts 8 and 9) multiplied by a temperature coefficient C of the inner casing 1, and a diameter d of the fixed contacts 8 and 9 multiplied by the temperature coefficient D of the fixed contacts 8 and 9.

Accordingly, in the modification of FIG. 9, in order to arrange so that an amount of variation $\delta$ at the functioning position becomes zero, the materials and dimensions of the respective members are selected to satisfy an equation, $$\delta=(L1\cdot A+L3\cdot B-L2\cdot C-d\cdot D)\Delta t\approx 0$$

where Δt represents the temperature variation.

In FIG. 10, there is shown a graph showing variation characteristics of functioning points with respect to temperatures in the electrical switch of FIG. 9. In this graph, the abscissa represents the distance L3 from the forward end of the plunger to the contact point in mm, while the ordinate denotes the variation amount at the forward end of the plunger.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical switch which comprises a casing formed into a cylindrical configuration with a pair of recesses being formed on an outer peripheral face of said casing in opposed positions along said outer peripheral surface, a pair of fixed contacts each formed by cutting a rod member into a predetermined length, and disposed in the casing to confront each other, each of said pair of fixed contacts being connected to a corresponding end of a lead terminal made of an electrically conductive thin plate, with the other end of said lead terminal being connected to a core wire of an external cord, said lead terminal being fitted into said recesses of said casing, a plunger slidably accommodated in said casing for movement in an axial direction, a bearing member within said casing slidably supporting said plunger, a movable contact formed by cutting a rod member into a predetermined length and mounted to an intermediate portion of said plunger in a direction intersecting with said fixed contacts, and a restoring means within said casing directed around the outer periphery of said plunger, said movable contact being restored together with said plunger to close said pair of fixed contacts in a free state.

2. An electrical switch as claimed in claim 1, wherein a width W1 of each of said lead terminals is set to be slightly larger than a width W2 in a circumferential direction of each of said recesses, whereby upon fitting of the respective lead terminals into the corresponding recesses, ends of said lead terminals engage side walls of said recesses by a spring force thereof acting in a circumferential direction of said cylindrical casing.

3. An electrical switch as claimed in claim 1, wherein the respective fixed contacts are adapted to be connected to an external cord through a printed substrate, said printed substrate being connected to said external cord through a terminal plate, said terminal plate including a plurality of terminals connected into one unit by a connecting portion and having groove portions at which said connecting portion can be broken off, whereby said connecting portion of said terminals plate is arranged to be broken off after said terminal plate has been connected to said printed substrate.

4. An electrical switch as claimed in claim 1, further including an outer casing provided around the outer peripheral surface of said casing, with an amount of variation Δ of functioning position being represented by an equation, $$\delta=(L1\cdot A+L3\cdot B-L2\cdot C-d\cdot D)\ t\approx 0$$

where

L1: distance from a center of the fixing hole to the forward end of the inner casing, L2: distance from the forward end of the inner casing to the fixed contacts, L3: distance from the forward end of the plunger to the contact point thereof, d: diameter of the fixed contacts, A: temperature coefficient of the outer casing, B: temperature coefficient of the plunger, C: temperature coefficient of the inner casing, D: temperature coefficient of the fixed contacts Δt: temperature variation.

5. An electrical switch as claimed in claim 4, wherein said outer casing is made of stainless steel, said casing being prepared from polybutylene terephthalate resin, said plunger being made of ceramics of alumina, and said fixed contacts are made of beryllium-copper alloy.

* * * * *